US007200923B2

(12) United States Patent
Matsumura et al.

(10) Patent No.: US 7,200,923 B2
(45) Date of Patent: Apr. 10, 2007

(54) FINISHING APPARATUS FOR SLIDE FASTENER

(75) Inventors: Satoshi Matsumura, Toyama (JP); Tatsuo Ito, Toyama (JP); Yoshiyuki Toishi, Namerikawa (JP); Taishin Kameda, Uozu (JP)

(73) Assignee: YKK Corporation, Tokyo (JP)

( * ) Notice: Subject to any disclaimer, the term of this patent is extended or adjusted under 35 U.S.C. 154(b) by 455 days.

(21) Appl. No.: 10/746,017

(22) Filed: Dec. 23, 2003

(65) Prior Publication Data

US 2004/0187301 A1 Sep. 30, 2004

(30) Foreign Application Priority Data

Jan. 10, 2003 (JP) ..... P. 2003-004718

(51) Int. Cl.
*A41H 37/06* (2006.01)

(52) U.S. Cl. ..... 29/768; 29/766; 29/767; 29/408

(58) Field of Classification Search ..... 29/766, 29/767, 768, 408, 33.2, 711, 771, 559
See application file for complete search history.

(56) References Cited

U.S. PATENT DOCUMENTS

| | | | | |
|---|---|---|---|---|
| 3,600,786 A | | 8/1971 | Hansen | |
| 3,815,208 A | * | 6/1974 | Kawakami | 269/254 R |
| 4,122,594 A | * | 10/1978 | Azzara | 29/408 |
| 4,625,398 A | * | 12/1986 | Kando | 29/768 |
| 4,809,414 A | * | 3/1989 | Sawada | 29/33.2 |
| 5,056,205 A | * | 10/1991 | Kuse et al. | 29/408 |
| 5,142,772 A | * | 9/1992 | Ishikawa | 29/768 |
| 5,501,000 A | * | 3/1996 | Kondo | 29/767 |
| 6,231,279 B1 | * | 5/2001 | Aufiero | 408/3 |

FOREIGN PATENT DOCUMENTS

| | | |
|---|---|---|
| EP | 0 269 912 A1 | 6/1988 |
| EP | 0 409 068 A2 | 1/1991 |
| EP | 0 657 120 A1 | 6/1995 |
| JP | 45-12162 | 5/1970 |
| JP | 60-236604 | 11/1985 |
| JP | 1-28565 | 6/1989 |
| JP | 3-97407 | 4/1991 |

* cited by examiner

*Primary Examiner*—Marc Jimenez
(74) *Attorney, Agent, or Firm*—Everest Intellectual Property Law Group; Michael S. Leonard

(57) ABSTRACT

There are provided left and right gripper devices for holding left and right tip side portions of a slide fastener chain, transferring the fastener chain in a longitudinal direction (an X-axis direction) and opening and closing the left and right tip side portions in a Y-axis direction orthogonal to the X-axis direction based on a command sent from operation control means. There is provided an electric motor for controllably driving the left and right gripper devices in the X-Y axis direction based on a command sent from a numeric control section of the operation control means in the X-Y axis direction of the gripper devices. A slider can be automatically inserted by only a specified operation using a single device without preparing a special device for all types of fastener chains and sliders and requiring a time for a considerable reconstruction.

8 Claims, 7 Drawing Sheets

FINISHING APPARATUS FOR SLIDE FASTENER

BACKGROUND OF THE INVENTION

1. Field of the Invention

The present invention relates to a finishing apparatus for a slide fastener which continuously manufactures the slide fastener from a long slide fastener chain, and particularly to a finishing apparatus for a slide fastener which can accurately pass a variety of sliders therethrough with a single apparatus.

2. Description of the Related Art

Usually, a slide fastener transfers a continuous slide fastener chain along a transfer path and cuts the fastener chain into a slide fastener unit on the way, and then inserts a slider through the fastener chain, and furthermore, attaches a stopper and sequentially finishes the slide fastener, and discharges the slide fastener thus finished to the outside of the transfer path. For example, according to Japanese Utility Model Publication JP-UM-B-45-12162, a previous finished slide fastener is pulled out forward by means of a second gripper, and at almost the same time, a next fastener chain is cut to have a unit length of the slide fastener and the tip space portions of left and right fastener tapes are held by a pair of left and right first grippers. Then, the fastener chain is opened like a Y shape while advancing the left and right first grippers and moving them in a separating direction, and the slider is inserted and a stopper is attached to the tip side portion of a fastener element train. At this time, a succeeding fastener chain is advanced following the next slide fastener finished completely. By the same operating procedure, the slide fastener is sequentially finished.

For example, Japanese Patent Publication JP-B-1-28565 has disclosed a finishing apparatus for a slide fastener in which two sliders having the same structure are attached in opposite directions to each other. First and second slider holders are provided in the transfer path for a continuous slide fastener chain and, for example, the slide fastener chain having a tip held by left and right grippers is transferred along the transfer path and the left and right grippers are moved in a transversely outward direction orthogonally to the transfer path, and the slide fastener chain is transversely opened like a Y shape, and at the same time, a first slider is inserted from a shoulder and the left and right grippers are caused to approach left and right inner parts orthogonally to the transfer path, and a second slider is inserted from a rear part while left and right stringers are closed like an inverted Y shape, and a stopper is then attached.

JP-UM-B-45-12162 and JP-B-1-28565, which are mentioned above, are known as related art.

A variety of slide fasteners are used depending on a combination of the width and length of a fastener chain, a material to be used in a fastener tape or a stopper, the structure and size of a slider including a handle, the direction of the slider to be attached to the fastener chain or the patterns or colors of components. For this reason, finishing apparatuses for a slide fastener corresponding to types are indispensable.

According to JP-UM-B-45-12162, for example, all combined operations in the advance direction of the fastener chains of left and right grippers and an orthogonal direction to the advance direction are carried out by a bending guide groove. In JP-B-1-28565, moreover, the operations of the same grippers depend on a cylinder. In general, the operations of the grippers are often carried out by using a cam. In the case in which the guide groove or the cam is used for a mechanism for controlling the operations of the left and right grippers as described above, the control of the kinetic loci of the grippers is uniformly determined by the guide grooves formed therein or the cams provided therein. Even if the direction of the insertion of the fastener chain into the slider is changed, consequently, a countermeasure cannot be taken instantly.

There are specifically two directions in which the fastener chain is inserted through the slider. In one of the directions, the fastener chain is divided into left and right fastener stringers to be opened like a Y shape, and a pair of fastener stringers are inserted from the shoulder of the slider and the elements of the fastener stringers are pulled out of the rear part of the slider in an engagement state. In this case, the left and right grippers are set in a separation state before they are inserted in the slider, and are moved with the insertion in an approach direction.

In the second direction of the insertion of the slider, the fastener chain having a pair of fastener stringers engaged is inserted from the rear part of the slider, and the fastener chain is divided into the fastener stringers to be pulled out of the shoulder of the slider. In this case, the left and right grippers are set in an approach state before they are inserted in the slider, and are moved with the insertion in a separating direction.

As described above, the two inserting ways have the kinetic loci of the left and right grippers which are different from each other. In the case in which the kinetic loci of the left and right grippers are uniform, therefore, control can correspond to only one of the inserting ways. Moreover, it is impossible to smoothly guide and insert the fastener chain into various sliders having different structures and sizes by using a finishing apparatus of the same type.

The slider guides the engaging and separating actions of the fastener element by a coupling column for coupling upper and lower blade plates and a flange protruded from at least one of the upper and lower blade plates, and the left and right grippers are moved over such a kinetic locus as to insert the fastener chain without causing the fastener element to collide with the coupling column and the flange.

If the structure and size of the slider is varied, the sizes and shapes of the coupling column and the flange, and furthermore, their positional relationship are varied. Even if the kinetic loci of the left and right grippers are to be uniformly controlled, therefore, the fastener element is forcibly inserted into the slider while colliding with the coupling column and the flange so that the fastener chain might be damaged.

For example, in the case in which the kinetic loci of the left and right grippers are to be controlled by employing a cylinder, moreover, a position can be roughly controlled for an accurate kinetic locus and precision in positioning is low. The left and right grippers hold the fastener tape in the fastener chain. Since the fastener tape is flexible, it expands and contracts by a tension applied thereto so that an error is apt to be made between a theoretical position and an actual position in the insertion. The rough control of the position in the kinetic loci of the left and right grippers causes the fastener element to be unreliably guided into the slider together with deformation caused by the expansion and contraction of the tape and the insertion into the slider cannot be smoothly carried out.

The control for the operation of the gripper in the finishing apparatus for a slide fastener is varied depending on the type of the fastener chain and the structure and size of the slider. If it is impossible to carry out the control of the position of the gripper with high precision corresponding to an error made by the kinetic loci depending on various sliders and the expansion and contraction of the fastener tape, the slider cannot be accurately inserted through the fastener chain. As a result, conventionally, a special device has been prepared for each type of the fastener chains and the sliders or a considerable reconstruction has been required every time their types are changed.

SUMMARY OF THE INVENTION

The object of the invention is to provide a finishing apparatus for a slide fastener having general versatility in which a slider can be automatically inserted by only a one-time operation by fingers using a single apparatus without preparing a special apparatus for all types of fastener chains and sliders and requiring a time taken for a considerable reconstruction. Another object of the invention is to provide a finishing apparatus in which a stopper attaching device and a fastener chain cutting device can be provided before and after a device for inserting the slider to consistently finish a slide fastener.

The object can be attained by a finishing apparatus for a slide fastener in which at least a slider is attached to a continuous slide fastener chain, having operation control means, left and right gripper devices for holding left and right tip side portions of the slide fastener chain, transferring the slide fastener chain in a longitudinal direction (an X-axis direction), and opening or closing the left and right tip side portions of the slide fastener chain in a Y-axis direction orthogonal to the X-axis direction, based on a command sent from the operation control means, and a slider supply section for inserting the slide fastener chain during an opening and closing operation of the left and right tip side portions of the slide fastener chain, wherein the operation control means in the X-Y axis direction of the left and right gripper devices includes a numeric control section, and the finishing apparatus further has electric motors for controllably driving the left and right gripper devices in the X-Y axis direction based on a command sent from the numeric control section.

According to the configuration, as described above, the continuous slide fastener chain to be transferred successively is usually formed by holding the space portion of the slide fastener chain from which teeth are removed from left and right by means of the left and right grippers provided on the left and right in a transfer direction in the middle of the transfer, dividing the same space portion into left and right stringers and opening them like a Y shape, causing the left and right stringers thus opened to approach each other again according to circumstances, and engaging the teeth attached to each of the stringers. When the slide fastener chain is opened or closed, the slider is inserted through the slide fastener chain.

The invention is most characterized in that all the operations in the X-axis direction to be the direction of the transfer of the fastener chain and the Y-axis direction which is orthogonal to the X-axis direction in the left and right gripper devices can be carried out by driving the electric motor for performing control in the X-Y axis direction based on an operation command signal sent from the numeric control section and inserting the slider through the slide fastener chain accurately with high precision for each type of the slide fastener chain and the slider. More specifically, the driving operations of the left and right gripper devices are controlled corresponding to the sequence of the whole apparatus based on data pre-stored in the numeric control section.

Furthermore, two electric motors for the X and Y axes are provided for each of the left and right gripper devices. Consequently, it is possible to independently carry out the control of a kinetic locus and the control of a speed in each of the left and right gripper devices based on data such as a speed and a rotating angle in which the numbers of the rotations of the respective electric motors are pre-stored in the numeric control section. When inserting the slide fastener chain through the slider, therefore, it is possible to change such a timing as to insert the left and right stringers. For example, in the case in which a pair of left and right fastener stringers in an opening state are inserted from the shoulder of the slider and the slide fastener chain is pulled out of the rear part of the slider while the elements of the fastener stringers are engaged, one of the fastener stringers is earlier inserted into the slider and a timing for inserting the other fastener stringer is delayed by one element so that the teeth are reliably engaged when the slide fastener chain is pulled out. In the case that the slide fastener chain with a pair of fastener stringers engaged with each other is inserted from the rear part of the slider and the slide fastener chain is divided into the fastener stringers to be pulled out of the shoulder of the slider, moreover, a position in which an upper stopper is to be attached can be varied on the left and right. More kinds of slide fasteners can be manufactured so that a finishing apparatus for a slide fastener having general versatility can be obtained.

According to the configuration, the numeric control section pre-stores data and sequences such as respective kinetic loci based on the combination of the slide fastener chain and the slider which are required for finishing the slide fastener. Consequently, if a switch for a desirable type or a combination on a touch panel is pressed, for example, a sequence adapted to the combination is automatically selected so that a motion in the X-Y axis direction for each type can be accurately given to the gripper device and general versatility can be obtained. A special device does not need to be prepared for each type differently from the conventional art or a considerable reconstruction is not required. Therefore, it is possible to particularly take a countermeasure against recent diversified small-quantity production rapidly, efficiently and economically.

Therefore, it is preferable that the numeric control section has a storage section which stores data such as kinetic locus of each of the left and right gripper devices to be controlled according to the types of the slider and the slide fastener chain. If the storage section can optionally write and erase data or can be replaced with a storage file which is created in advance, a countermeasure can be taken against every situation.

Since the finishing apparatus according to the invention can optionally set the kinetic locus of the gripper device, moreover, it can also serve as a so-called finishing apparatus for a reverse opening slide fastener in which two sliders are attached to a single slide fastener in opposite directions to each other. More specifically, the slider holding sections are provided in two places in a transfer path of the slide fastener chain, and the numeric control section can also store data such as the kinetic loci of the left and right gripper devices for inserting the two sliders through the slide fastener chain in a slide fastener unit in opposite directions to each other.

The reverse opening slide fastener is inserted through the slide fastener chain with the shoulders or rear parts of the two sliders facing each other. For this reason, when the shoulders are opposed to each other and are inserted through the slide fastener chain, for example, a first slider is held by a proper slider holder provided in a first slider inserting section with a rear part thereof turned toward the upstream side at the upstream side in the direction of the transfer of the slide fastener chain and a second slider is held by the slider holder of a second slider inserting section provided on the downstream side of the first slider inserting section with a rear part thereof turned toward the downstream side.

The transferred slide fastener chain is stopped when reaching the standby position of the gripper device, and the left and right grippers hold the tip space portion of the slide fastener chain from left and right. At this time, an operation for opening and closing the gripper is usually carried out by moving an opening and closing member using a cylinder provided in the gripper device. The left and right gripper devices are driven and advanced in the X-axis direction by first and second X-axis driving electric motors which are exclusive based on a command signal sent from the numeric control section, thereby transferring the fastener chain in the same direction. When the tip of the engaged tooth train of the slide fastener chain reaches the first slider holding section, the left and right gripper devices are moved in the Y-axis direction in such a direction that they are separated from each other by first and second Y-axis driving electric motors which are exclusive respectively, thereby opening the fastener tape like a Y shape. At this time, the first slider held by the first slider holding section is inserted from a rear part to a shoulder thereof.

After the first slider is inserted, similarly, the left and right gripper devices are continuously advanced by the first and second X-axis driving electric motors which are successively driven. When the left and right gripper devices reach the closing and opening position of the fastener chain, the first and second Y-axis driving electric motors are started to be rotated reversely based on a reverse rotating signal sent from the numeric control section to operate the left and right gripper devices to approach each other in the Y-axis direction. In this case, a second slider holding section is provided in the vicinity of the closing end of the fastener chain and the second slider held by the second slider holding section is inserted through the fastener chain from a shoulder to a rear part thereof with the advance of the fastener chain, and the left and right tooth trains are engaged with each other so that the slide fastener chain is closed.

When the first and second sliders are to be inserted through the slide fastener chain with the rear parts facing each other, the driving operations of the first and second X-axis and Y-axis driving electric motors are controlled to move the left and right gripper devices in the X-axis direction at a predetermined speed and in a separating Y-axis direction and to open the fastener chain, thereby inserting the first slider from the shoulder and then inserting the second slider from the rear part. All these driving operations are controlled in accordance with the sequence pre-stored in the numeric control section, and the left and right gripper devices are controllably driven within a range of 0.3 mm or less with high precision.

In the invention, furthermore, a stopper fixing device can be provided in a stopper fixing position of the X-axis direction of the gripper device. In this case, when the single slider is to be inserted, a device for attaching a lower stopper is provided in the vicinity of a fastener chain introducing section. After the slide fastener unit of a continuous fastener chain is introduced, the lower stopper is attached to the end of a space portion provided on the upstream side and the slider is inserted. Then, the upper stopper is attached to the tip side portions of the tooth trains of the left and right stringers opened like a Y shape, respectively. When a reverse opening slide fastener is to be finished, the stopper attaching device is provided on the upstream and downstream sides of the first and second slider inserting sections respectively and the stoppers are attached to the front and rear ends of the tooth train of the slide fastener to be finished, respectively.

In the invention, moreover, a cutting device can be further provided in a position where the slide fastener chain is to be introduced. As described above, in the case that the cutting device is provided on the upstream side of the stopper fixing device provided on the upstream side of the fastener chain, for example, the space portion can automatically be cut by the cutting device after or before the stopper is fixed. When passing through the finishing apparatus according to the invention, the slide fasteners are finished respectively.

DETAILED DESCRIPTION OF THE PREFERRED EMBODIMENTS

Figure 1:
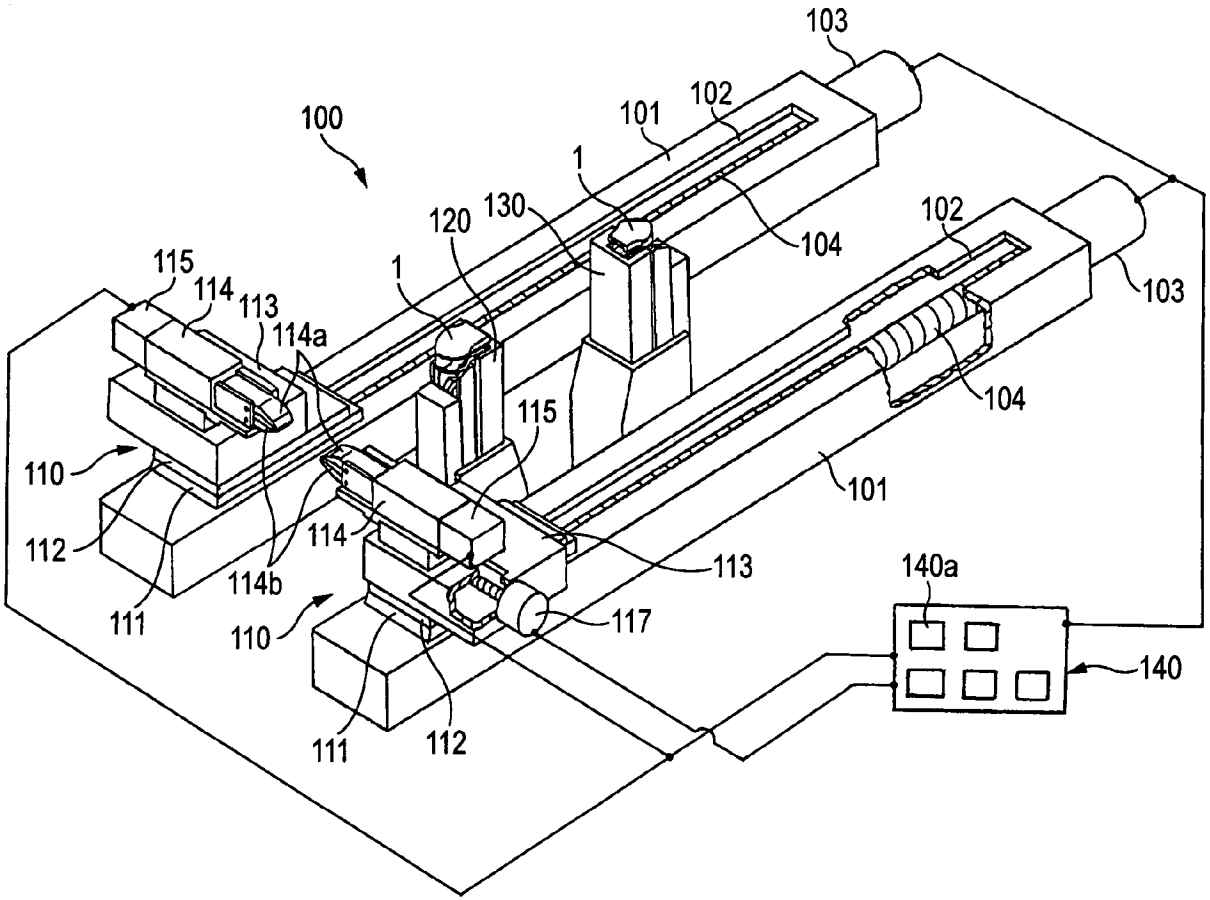
FIG. 1 is a general perspective view showing a finishing apparatus for a slide fastener according to a typical embodiment of the invention, a part thereof is cut out.
Figure 2:
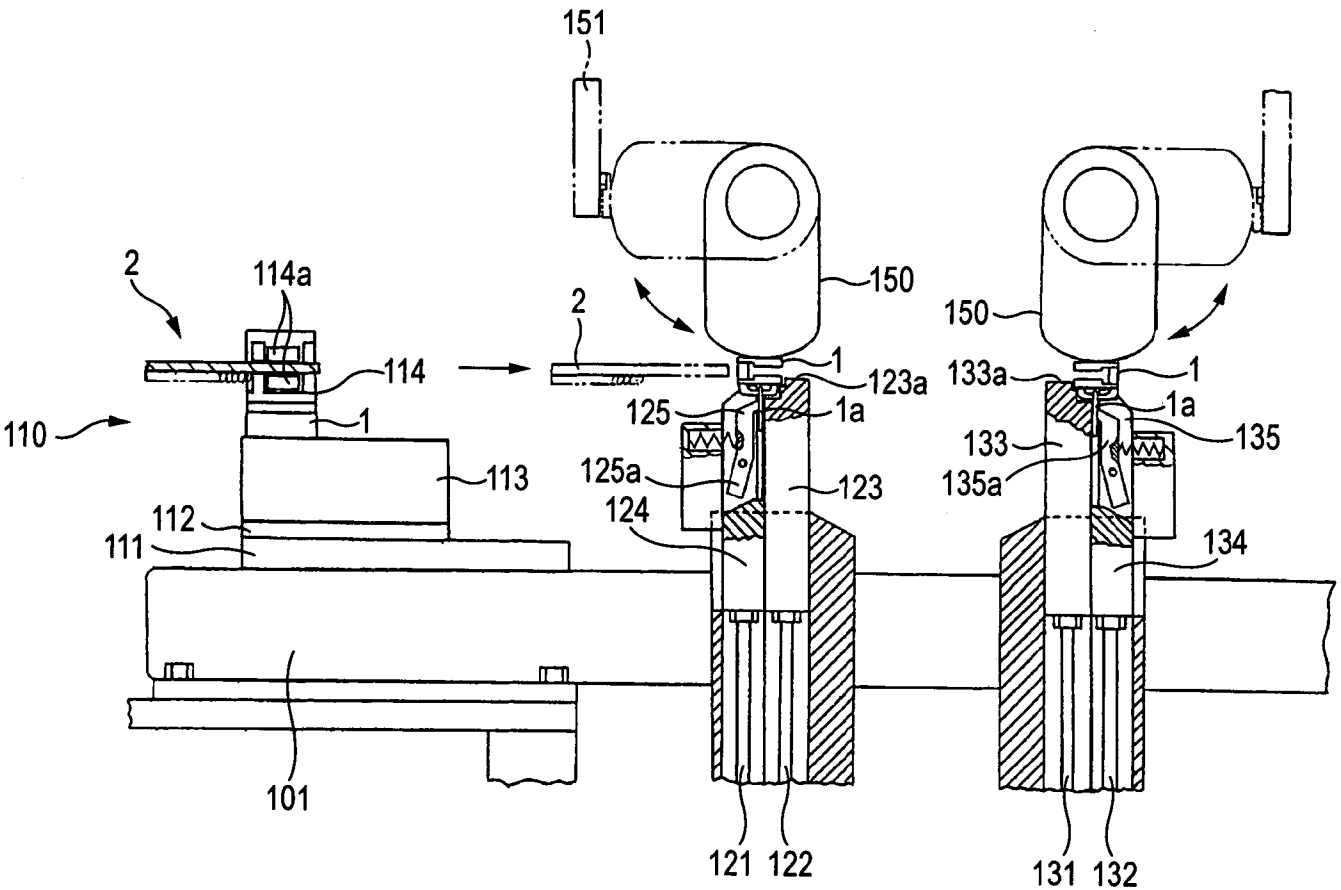
FIG. 2 is a side view showing an example of an operating procedure for finishing a slide fastener having first and second sliders by the finishing apparatus.

Preferred embodiments of the invention will be specifically described below with reference to the drawings. FIG. 1 is a view showing a whole structure of a typical example of a finishing apparatus for a slide fastener according to a embodiment of the invention, particularly, a finishing apparatus for a reverse opening slide fastener, a part of which is cut out. FIG. 2 is an explanatory view showing a procedure for inserting a slider by the finishing apparatus. If one of slide holding sections provided in a plurality of places is left in a transfer path for a fastener chain and the other slider holding sections are caused to retreat from the same transfer path, the finishing apparatus for a slide fastener can also be used for finishing a normal single opening slide fastener having one slider as well as the reverse opening slide fastener.

A finishing apparatus 100 for a slide fastener shown in these drawings has a pair of left and right X-axis delivery tables 101 provided in parallel in a machine frame F and having predetermined lengths, a pair of left and right gripper devices 110 including a gripper 114 for running over the delivery tables 101 in an X-axis direction to be a longitudinal direction and moving in a Y-axis direction orthogonal to an X-axis, first and second slider holders 120 and 130 provided between the left and right X-axis delivery tables 101 at a predetermined interval over a transfer path for a fastener chain 2, and a operation control section 140 for sending an operation signal to various operating devices and operating members which will be described below based on a preset sequence. The operation control section 140 has a numeric control section 140*a* which sends a signal to control first and second X-axis driving electric motors 113 and first and second Y-axis driving electric motors 117 based on various data stored in a memory which is included in the numeric control section 140*a*.

The left and right X-axis delivery tables 101 have the same structure. The X-axis delivery table 101 is a hollow, cylindrical and long box having a rectangular section and has an upper surface provided with an elongated slit-shaped guide hole 102 over front and rear ends. Moreover, first and second X-axis driving electric motors 103 having servo functions are fixed to ends in the longitudinal direction of the left and right X-axis delivery tables 101 respectively, and output shafts thereof are coupled to the ends of ball screws 104 extended in the hollow portions of the X-axis delivery tables 101. In addition, a movement can also be carried out by a linear motor.

On the other hand, the left and right gripper devices 110 are provided symmetrically and have the same structure and operating mechanism, and include a Y-axis moving table 111 screwed into the ball screw 104 and having a nut member (not shown) fixed to a lower surface, a Y-axis delivery table 113 fixed to the Y-axis moving table 111 through a fixing plate 112, a gripper 114 for moving forward and backward over the upper surface of the Y-axis delivery table 113 in a Y-axis direction, a cylinder 115 fixed to the rear part of the gripper 114 and vertically opening and closing a jaw section 114*a* of the gripper 114, and first and second Y-axis driving electric motors 117 coupled to the left and right grippers 114 through a nut (not shown) and having a servo function for independently driving each of the grippers 114 in the Y-axis direction forward and backward.

The slider holders 120 and 130 to be the first and second slider holding sections can employ well-known holders, and can also employ the slider holder disclosed in JP-B-1-28565 mentioned above, for example. Therefore, brief description will be given by taking, as an example, the slider holder disclosed in JP-B-1-28565.

The first and second slider holders 120 and 130 shown in FIGS. 1 and 2 have the same structure and are provided in opposite directions to each other in the direction of the transfer of a fastener, and include stopper blocks 123 and 133 and engagement blocks 124 and 134 which are moved vertically by first and second cylinder rods 121 and 122, and 131 and 132 as shown in FIG. 2. The upper ends of the stopper blocks 123 and 133 are provided with mounting surfaces 123*a* and 133*a* for holding the slider 1 together with the damper of a slider transfer holder 150 and blocking sections (not shown) for blocking the tips of left and right stringers 3. The engagement blocks 124 and 134 are provided with engagement levers 125 and 135 for engaging handles 1*a* of a slider 1. The tip engaging portions of the engagement levers 125 and 135 are always energized toward the stopper blocks 123 and 133, and arms 125*a* and 135*a* are operated upon receipt of a signal sent from the operation control section 140 and the engagement levers 125 and 135 are rotated and are thus disengaged from the handles 1*a*.

Figure 3:
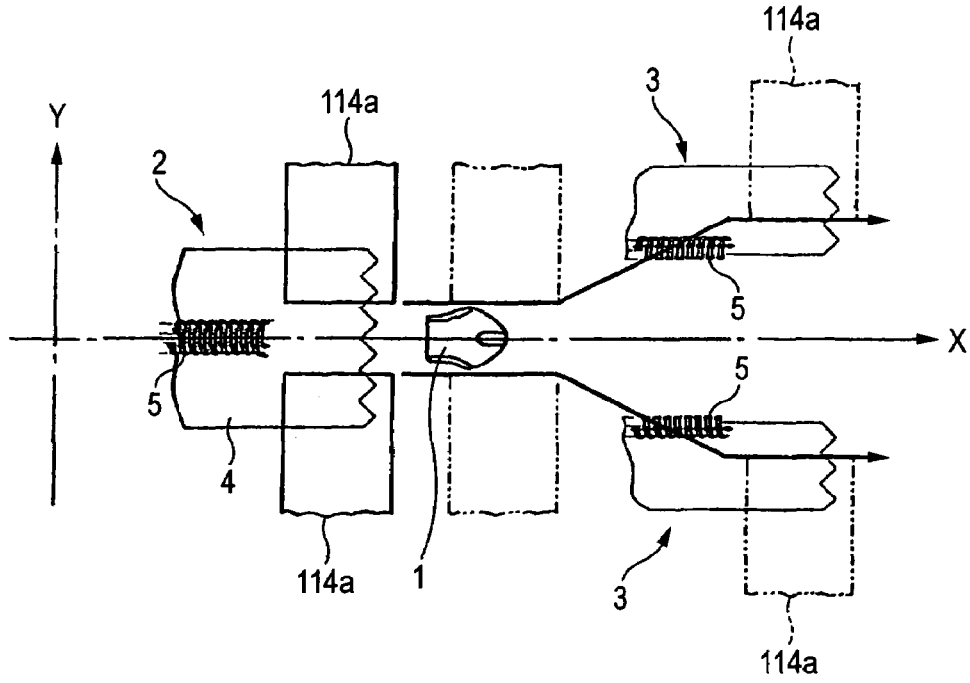
FIG. 3 is an explanatory view showing a procedure for finishing a single opening slide fastener by the finishing apparatus.

By using the finishing apparatus 100 for a slide fastener according to the embodiment having the structure, specific description will be given to procedures for finishing an ordinary single opening slide fastener and a reverse opening slide fastener based on two kinds of specifications with reference to FIGS. 3 to 6 respectively. FIG. 3 is an explanatory view showing a finishing procedure in which the single slider 1 is to be inserted through the left and right stringers 3 of the fastener chain 2. The fastener chain 2 is moved in an X-axis direction from left to right in FIG. 2.

In FIGS. 1 to 3, the tip of the fastener chain 2 is introduced into the finishing apparatus 100 in accordance with a present sequence. At this time, the first and second cylinder rods 121 and 122 of the first slider holder 120 is shrank, and the stopper block 123 and the engagement block 124 retreat downward in the transfer path for the fastener chain 2. When the tip side portion of the fastener chain 2 is introduced into the finishing apparatus 100, the first and second Y-axis driving electric motors 117 are operated based on a signal sent from the numeric control section 140*a* to move the left and right gripper devices 110 in standby positions toward the tip portions of the left and right stringers 3. At this time, the cylinders 115 and 115 attached to the gripper devices 110 are set in a contraction state and the jaw sections 114*a* of the grippers 114 are set in an opening state.

When the jaw sections 114*a* of the grippers 114 reach positions where a fastener tape 4 is held by the left and right fastener stringers 3, the driving operations of the first and second Y-axis driving electric motors 117 are stopped. At the same time, the cylinders 115 are extended. to close the jaw sections 114*a*, thereby holding the tip side portions of the left and right fastener tapes 4 as shown in a solid line of FIG. 3. When the holding is ended, a command signal is generated from the numeric control section 140*a* so that the first and second X-axis driving electric motors 103 are started to be driven and rotated. Consequently, the left and right gripper devices 110 are moved to the position of the slider 1 held by the first slider holder 120 at a predetermined speed in the X-axis direction.

When the tip side portion of the fastener chain 2 held by the left and right gripper devices 110 reaches the second slider holder 130 and the slider 1 is inserted from a rear part into the tip of a fastener element train 5, the first and second Y-axis driving electric motors 117 are started to be driven in a reverse rotating direction to move the left and right gripper devices 110 along the Y-axis in a separating direction. During the Y-axis movement, the first and second X-axis driving electric motors 103 are continuously driven and rotated to move the left and right gripper devices 110 along the X-axis simultaneously with the Y-axis movement. As a result, the fastener chain 2 is divided into the left and right fastener stringers 3 in the position in which the slider 1 is held, and the insertion of the slider 1 is continuously carried out while a transfer is wholly performed like a Y shape.

The opening angle of the left and right stringers 3 in the Y-like transfer is varied depending on the size and material of a fastener element 5*a*. If the angle is not proper, the fastener stringer 3 is not appropriately bent so that the insertion cannot be continuously carried out. Consequently, such a situation that the apparatus is to be stopped might be brought. Depending on the type of a slide fastener S, moreover, when the left and right fastener stringers 3 are to be inserted into the slider 1, timings are to be varied on the left and right respectively. If not so, there is a possibility that the fastener chain 2 might not be accurately inserted through the slider 1 and the engagement of the fastener element 5*a* might not be properly carried out.

In this respect, according to the apparatus of the invention, the numbers of the rotations and rotating speeds of the X-axis driving electric motor 103 and the Y-axis driving electric motor 117, that is, moving distances and speeds in the X-axis and Y-axis directions of the gripper device 110 can be controlled with high precision over various data inputted previously in the first and second X-axis driving electric motors 103 and the first and second Y-axis driving electric motors 117. Even if the slide fastener and components thereof are varied, therefore, the control can always be carried out to obtain a proper opening angle. Furthermore, the respective insertion timings of the left and right fastener stringers 3 can be changed. Therefore, the insertion timings can be optimized on the left and right.

When the tips of the left and right fastener stringers 3 reach predetermined positions, the driving and rotating operations of the first and second Y-axis driving electric motors 117 are stopped. Also at this time, the first and second X-axis driving electric motors 103 are continuously driven and rotated, and the left and right fastener stringers 3 are continuously transferred in a parallel state. When the tips of the left and right fastener stringers 3 transferred in parallel reach an upper stopper fixing device 160 shown in FIG. 8, the driving and rotating operations of the first and second X-axis driving electric motors 103 are stopped and left and right upper stoppers (not shown) are attached to the tip of each of the element trains 5 of the left and right fastener stringers 3.

Moreover, the left and right gripper devices 110 can be driven independently. In the case that the upper stopper is to be fixed, therefore, the position of the upper stopper in the fastener chain 2 can be shifted in the sliding direction of the slider 1 in the left and right fastener stringers 3. Thus, it is also possible to shift positions where the left and right upper stoppers are to be fixed. For the upper stopper fixing device 160, there is employed a well-known united device which has conventionally been used.

Figure 7:
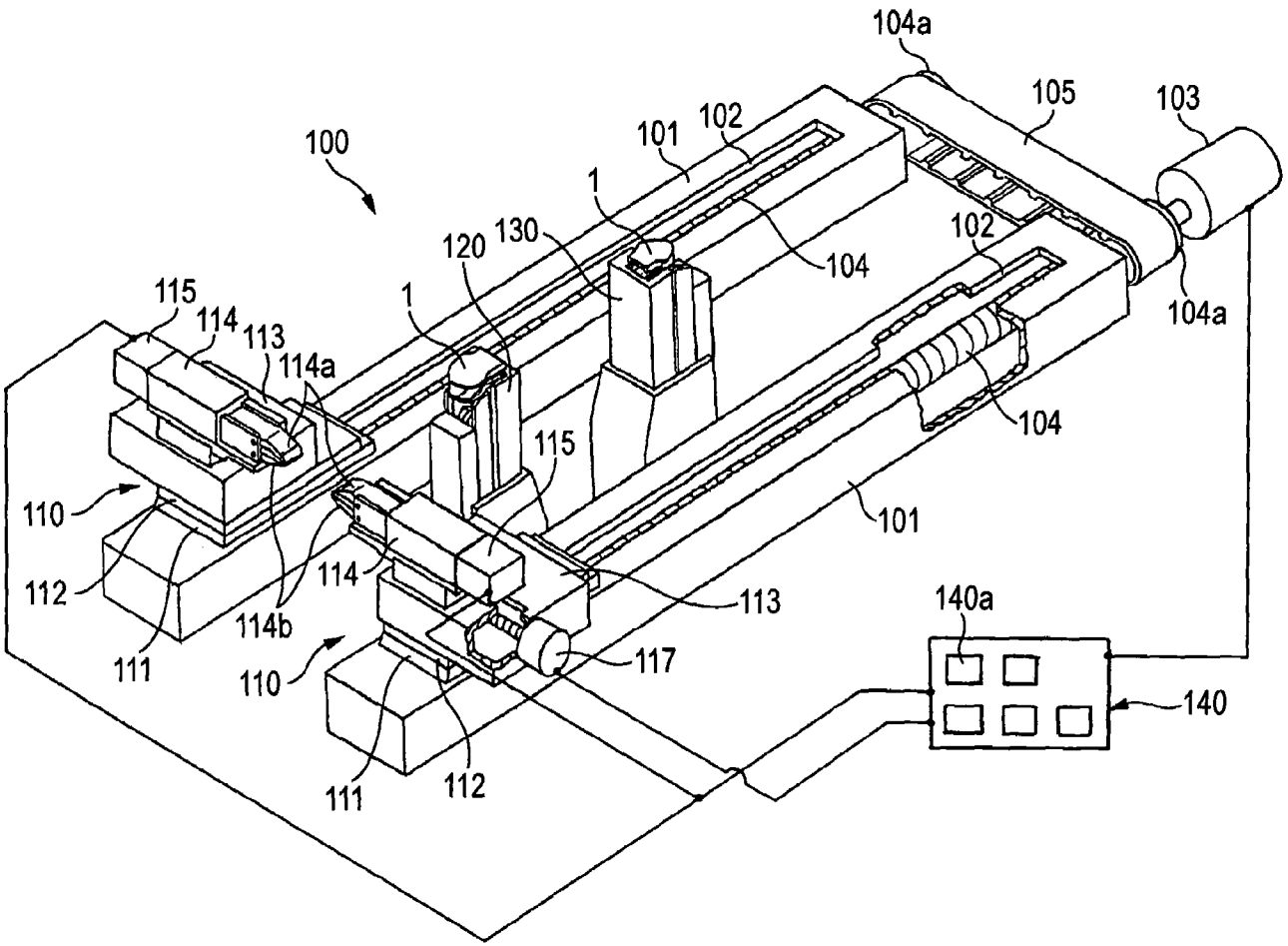
FIG. 7 is a general perspective view showing an apparatus for finishing a slide fastener according to another typical embodiment of the invention, a part of which is cut out.

In the finishing apparatus 100 for the slide fastener S, the first and second X-axis driving electric motors 103 are fixed to the left and right X-axis delivery tables 101 respectively and the left and right sliders 1 are controlled independently. In particular, in the case that the delivery in the X-axis direction does not need to be controlled independently on the left and right when finishing the slide fastener S, that is, the slide fastener S capable of simultaneously inserting the left and right fastener stringers 3 in the slider 1 can be finished or the upper stopper can be fixed into the same positions on the left and right when the fastener chain 2 is to be inserted into the slider 1, it can be proposed to use one driving source for the movement of the gripper device 110 in the X-axis direction as shown in FIG. 7. With the structure, a timing pulley 104*a* is coupled to one of the ends of the ball screw 104 extended in the hollow portion of each of the left and right X-axis delivery tables 101 and the output shaft of the X-axis driving electric motor 103 is coupled to the timing pulley 104*a* on one of sides. Both of the left and right timing pulleys 104*a* are coupled through a timing belt 105 and a movement in the X-axis direction is carried out by the X-axis driving electric motor 103 coupled to one of the sides. Also in this case, a movement in the Y-axis direction of the left and right gripper devices is carried out by the first and second Y-axis driving electric motors 117.

Figure 8:
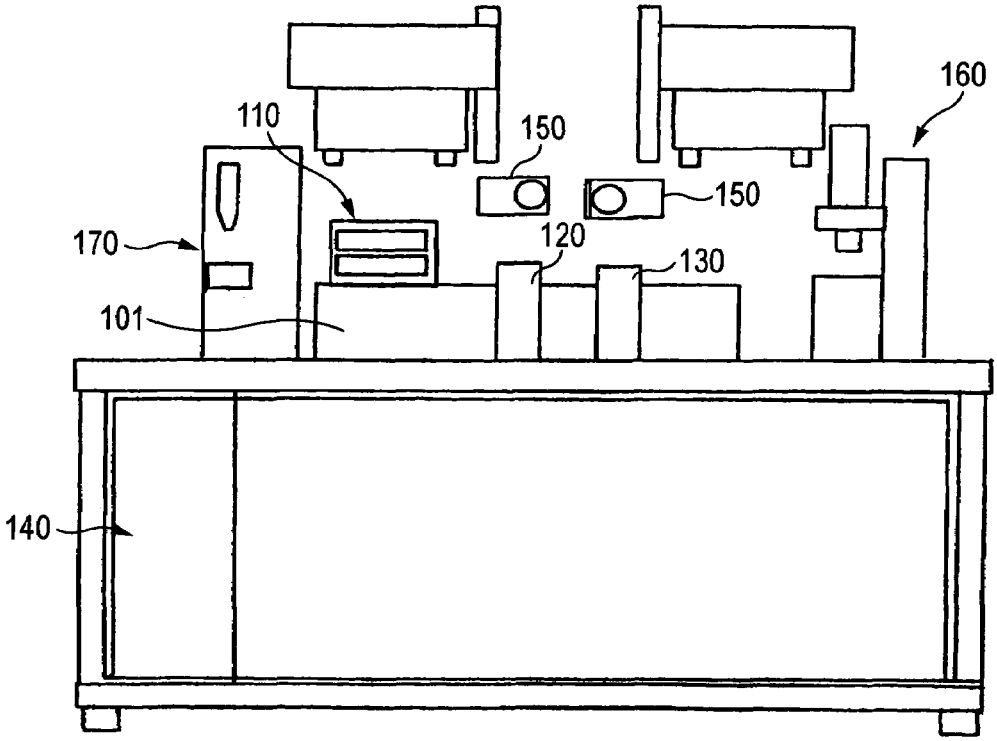
FIG. 8 is a general block diagram showing a structure according to a further embodiment of the invention.
Figure 9A:
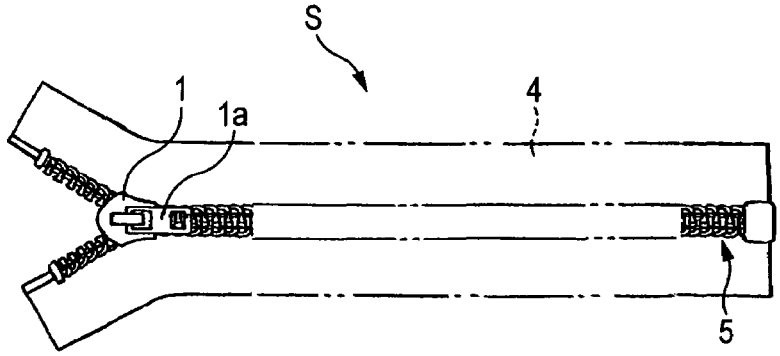
FIGS. 9A to 9C are plan view showing slide fasteners having different specifications which are finished by the apparatus according to the invention.

As schematically shown in FIG. 8, a chain cutting device 170 may be provided adjacently to the introducing end of the fastener chain 2 of the X-axis delivery table 101. When the attachment of the upper stopper by the upper stopper fixing device 160 is completed, the cutting device 170 is operated to cut the fastener chain 2. Thereafter, the single opening slide fastener S having the single slider 1 attached thereto shown in FIG. 9A which has completely be finished is received by a fastener take-out device (not shown) for standing by on the downstream side of the upper stopper fixing device 160 and is discharged to a storage place. For the cutting device and the fastener take-out device, similarly, it is possible to employ the well-known device which has been disclosed in JP-UM-B-45-12162 mentioned above, for example.

Figure 4:
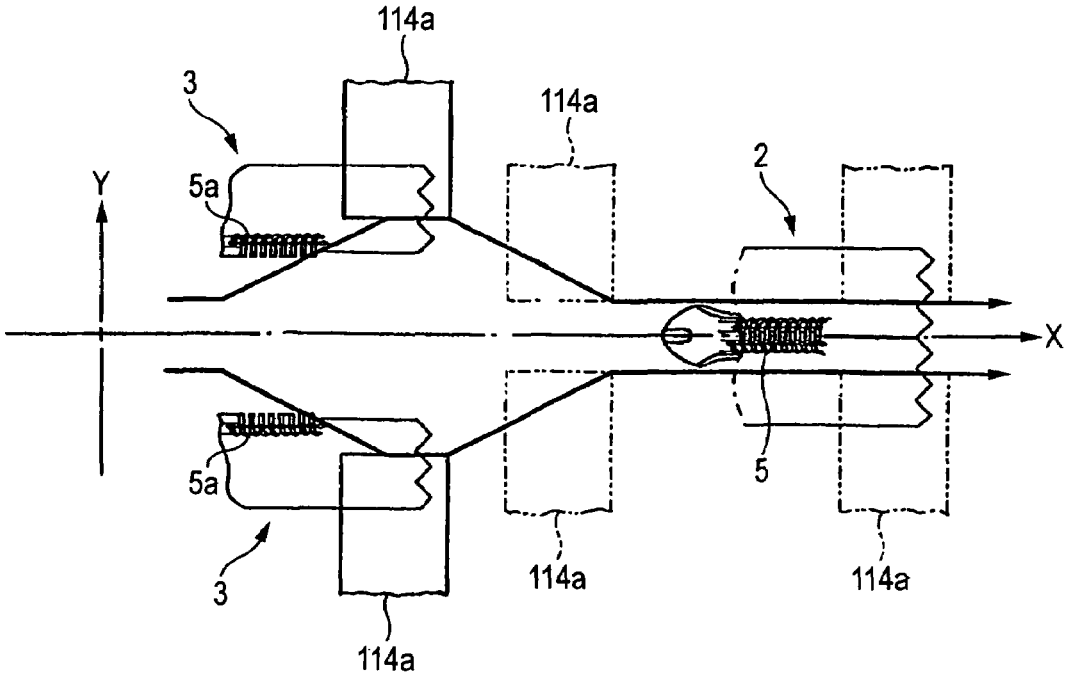
FIG. 4 is an explanatory view showing another procedure for finishing a single opening slide fastener by the finishing apparatus.

FIG. 4 shows the same procedure for finishing a single opening slide fastener using the finishing apparatus 100 according to the invention. The finishing procedure of FIG. 4 is greatly different from that of FIG. 3 in that the fastener chain 2 is inserted from the shoulder of the slider 1 when the slider 1 is to be inserted through the fastener chain 2. Accordingly, an upper stopper (not shown) is previously fixed to a space portion on an upstream side corresponding to the length of a slide fastener unit to be finished by an upper stopper fixing device (not shown). Moreover, the fastener chain 2 is inserted from the shoulder of the slider 1. Therefore, the second slider holder 130 retreats to the lower part of the transfer path for the fastener chain 2 and the cylinder rods 121 and 122 of the first slider holder 120 are instead operated in an extending direction to interpose the slider 1 together with a damper (not shown). Moreover, it is a matter of course that the kinetic locus of the gripper 114 is also different.

In the embodiment, referring to all of the operating devices and operating members in the apparatus described above, sequence control based on kind data such as the dimension and structure of the slider 1 pre-stored in the numeric control section 140*a*, the material, kind and dimension of the fastener element 5, the width of the fastener chain and the kind of the slide fastener, and a program corresponding to each of the kinds or a combination of plural kinds is automatically selected by simply pressing a selection switch on a touch panel (not shown) in the control section. As a result, also in the different finishing procedure shown in FIG. 4, a single opening slide fastener can automatically be finished in a procedure shown in the drawing if a corresponding switch on the touch panel is pressed.

In the embodiment shown in FIG. 4, the tip side portion of the continuous fastener chain 2 in a closing state is transferred into the chain introducing portion of the finishing apparatus 100, and the transfer is stopped when the same tip side portion reaches the holding position of the gripper device 110. The first and second Y-axis driving electric motors 117 are started to be rotated, thereby moving the gripper device 110 from a standby position to the left and right holding positions of the fastener tape 4 in the Y-axis direction and holding the tape end of the fastener tape 4 by the jaw sections 114*a*. When the holding is ended, the first and second Y-axis driving electric motors 117 are reversely rotated to move the left and right gripper devices 110 in a separating direction. At the same time, the first and second X-axis driving electric motors 103 are started to be driven and rotated, and the left and right gripper devices 110 are simultaneously moved in the X-axis direction in addition to the Y-axis movement. After the fastener chain 2 is once opened like a Y shape, the first and second Y-axis driving electric motors 117 are normally rotated while the driving and rotating operations of the first and second X-axis driving electric motors 103 are maintained. Thus, the left and right gripper devices 110 are caused to approach in the Y-axis direction to close the fastener stringers 3 opened transversely.

At the time of the closing, the slider 1 held by the first slider holder 120 is inserted from the shoulder through the respective fastener stringers 3, thereby engaging the fastener element trains. In the finishing apparatus according to the invention or by the well-known lower stopper fixing device 160 and cutting device 170 shown in FIG. 8 which are provided separately, next, a lower stopper (not shown) is fixed to a tip portion in the direction of the transfer of the element train of the fastener chain 2, and furthermore, the fastener chain 2 is cut in a space portion on the upstream side to finish the single opening slide fastener S. Also in the finishing procedure shown in FIG. 4, in the same manner as the finishing procedure shown in FIG. 3, all of the operating devices and operating members are operated with high precision based on a program stored in the numeric control section 140*a*.

Figure 5:
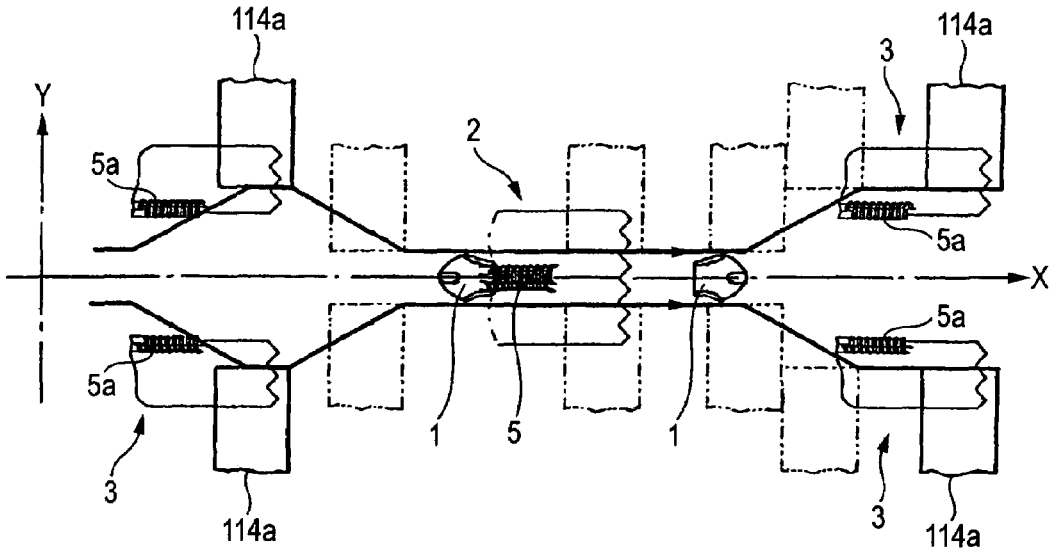
FIG. 5 is an explanatory view showing a procedure for finishing a reverse opening slide fastener by the finishing apparatus.
Figure 9B:
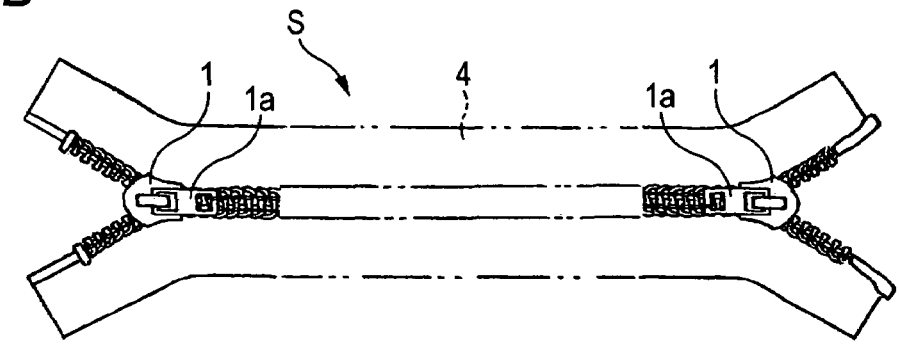

FIG. 5 is an explanatory view showing a procedure for finishing a reverse opening slide fastener using the finishing apparatus 100. In an embodiment shown in FIG. 5, two sliders 1 are inserted through the fastener chain 2 with rear parts facing each other. In the embodiment, therefore, the left and right gripper devices 110 are controlled in the middle of the transfer of the fastener chain 2, and the left and right stringers 3 of the fastener chain 2 held by the left and right grippers 114 are separated and opened before reaching the inserting position of the first slider 1 held by the first slider holder 120, and thereafter, the left and right fastener stringers 3 are closed, and at the same time, are inserted from the shoulder of the first slider 1. Then, the fastener chain 2 is inserted from the rear part of the second slider 1 in the inserting position of the second slider 1 held by the second slider holder 130 to transversely open the left and right stringers 3 again and to transfer them in parallel in a constant opening state. FIG. 9B shows the reverse opening slide fastener S obtained by fixing the stopper and then cutting the fastener tape 4.

Figure 6:
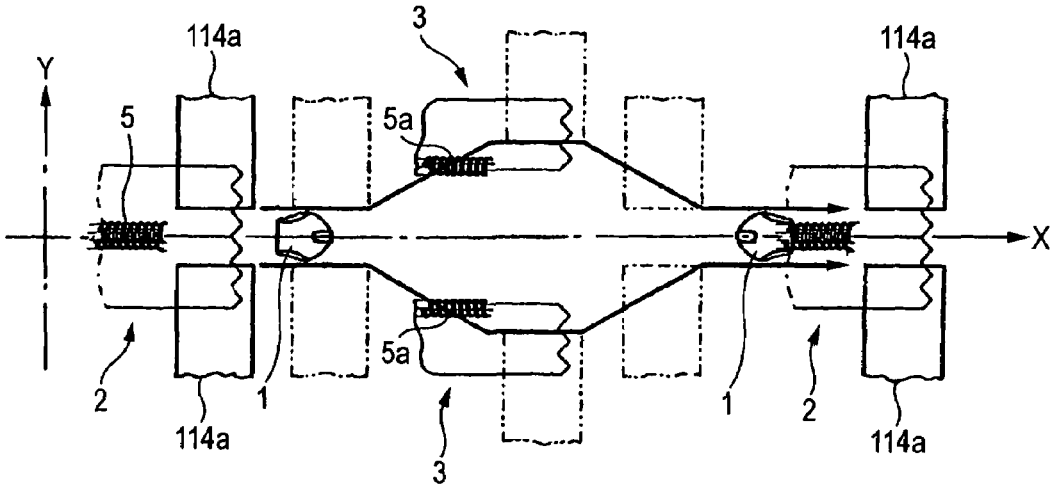
FIG. 6 is an explanatory view showing another procedure for finishing a reverse opening slide fastener by the finishing apparatus.
Figure 9C:
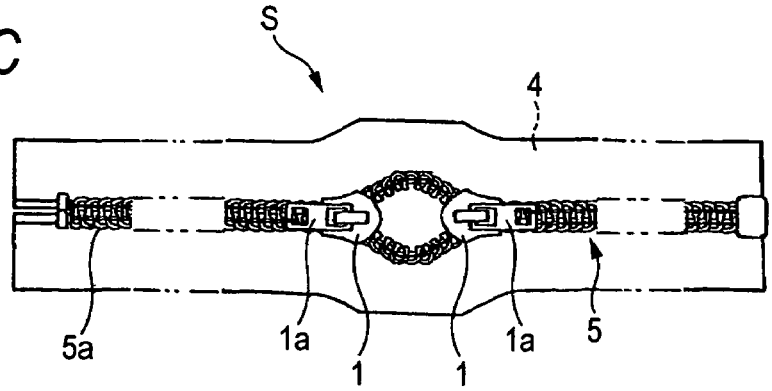

FIG. 6 is an explanatory view showing another procedure for finishing a reverse opening slide fastener using the finishing apparatus 100. In an embodiment shown in FIG. 6, two sliders 1 having shoulders facing each other are inserted through the fastener chain 2. Therefore, the fastener chain 2 set in a closing state is inserted from the rear part of the first slider 1 held by the first slider holder 120 in the middle of holding transfer by the gripper device 110, and the left and right gripper devices 110 are controlled to separate and open the left and right stringers 3 of the fastener chain 2, and to then close them again. During the closing, the left and right stringers 3 are inserted from the shoulder of the second slider 1 to engage the left and right fastener element trains and to transfer them in the X-axis direction. FIG. 9C shows the reverse opening slide fastener S obtained by fixing the stopper and then cutting the fastener tape 4.

When the type of the slide fastener S is varied, the fastener chain, the slider and the stopper corresponding thereto are also changed. In the finishing apparatus 100 according to the invention, it is necessary to replace the first and second slider holders 120 and 130, the stopper fixing device 160 and the cutting device 170. For this reason, it is preferable that these devices should be united or a chain cassette should be used. FIG. 7 shows an example of the specification. Thus, necessary devices are united. By replacing the devices for each type, consequently, it is possible to automatically finish all the slide fasteners S to be produced by using the single finishing apparatus 100. Furthermore, not only the first and second slider holders 120 and 130 are replaced but also slide holders having the same structure are provided additionally at a predetermined interval over the transfer path for the fastener chain 2. Thus, three sliders or more can also be inserted through the fastener chain.

Moreover, all the movements are controlled with high precision by sequence control based on the program stored in the numeric control section 140*a* as described above. It can be understood from the description that at least the motion of the gripper device 110 is sequence controlled with high precision based on various programs and all kinds of data which are stored in the numeric control section 140*a* in the finishing apparatus 100 for a slide fastener according to the invention. Consequently, sliders having a variety of specifications can be passed through with a single apparatus. Thus, diversified small-quantity production can be implemented efficiently and inexpensively.

What is claimed is:

1. A finishing apparatus for a slide fastener in which at least a slider is attached to a continuous slide fastener chain, comprising:

operation control means;

left and right gripper devices for holding left and right tip side portions of the slide fastener chain, transferring the slide fastener chain in a longitudinal direction (an X-axis) direction), and opening or closing the left and right tip side portions of the slide fastener chain in a Y-axis direction orthogonal to the X-axis direction, based on a command sent from the operation control means; and slider holding sections for inserting the slide fastener chain into the slider during an opening and closing operation of the left and right tip side portions of the slide fastener chain, wherein the operation control means in the X-Y axis direction of the left and right gripper devices includes a numeric control section, and the finishing apparatus further comprises electric motors for controllably driving the left and right gripper devices in the X-Y axis direction based on a command sent from the numeric control section, wherein the numeric control section has a storage section which stores data including at least one of kinetic loci, speeds and sequences of the left and right gripper devices to be controlled according to types of the slider and the slide fastener chain, and wherein the electric motor for driving the gripper devices is controlled by using the data of the storage section for even type of the slider.

2. The finishing apparatus according to claim 1, wherein the controllable driving operation in the X-Y axis direction of the left and right gripper devices is carried out by the two electric motors for the X and Y axes, and the respective electric motors are controllably driven independently.

3. The finishing apparatus according to claim 1, wherein the slider holding sections are provided in a transfer path of the slide fastener chain.

4. The finishing apparatus according to claim 1, wherein the slider holding sections have an exchange mechanism based on a type of the slider.

5. The finishing apparatus according to claim 1, wherein a stopper fixing device is provided in a stopper fixing position of the X-axis direction of the gripper device.

6. The finishing apparatus according to claim 1, wherein a cutting device is further provided in a position where the slide fastener chain is to be introduced.

7. The finishing apparatus according to claim 1, wherein each of the kinetic loci and the speed stored in the storage section is determined by a combination of the electric motor controlled in the X-axis direction and the electric motor controlled in the Y-axis direction.

8. The finishing apparatus according to claim 1, wherein the left and right gripper devices comprise:

a pair of left and right X-axis delivery tables extending along the X-axis direction; and grippers which move along the X-axis direction on each of the X-axis delivery tables and move forward and backward along the Y-axis direction by the electric motor for controlling the Y-axis direction to grip the fastener chain.

* * * * *